US006328853B1

(12) United States Patent
Goodnow et al.

(10) Patent No.: US 6,328,853 B1
(45) Date of Patent: Dec. 11, 2001

(54) COMPLIANT TOP PLATE DOCTORING APPARATUS

(75) Inventors: Ronald F. Goodnow, Leicester; Allen Brauns, Sturbridge; David Benoit, Cherry Valley, all of MA (US)

(73) Assignee: Thermo Web Systems, Inc., Auburn, MA (US)

( * ) Notice: Subject to any disclaimer, the term of this patent is extended or adjusted under 35 U.S.C. 154(b) by 0 days.

(21) Appl. No.: 09/490,213

(22) Filed: Jan. 24, 2000

Related U.S. Application Data

(60) Provisional application No. 60/117,951, filed on Jan. 29, 1999.

(51) Int. Cl.[7] ..... D21G 3/00

(52) U.S. Cl. ..... 162/281; 15/256.51; 162/272

(58) Field of Search ..... 162/111, 198, 162/199, 272, 281, 280, 282; 15/256.51, 256.53; 101/120, 157, 169, 350.6; 118/100, 107, 110, 119, 126, 261; 210/396; 399/284; 427/356

(56) References Cited

U.S. PATENT DOCUMENTS

| | | | | |
|---|---|---|---|---|
| 3,163,878 | | 1/1965 | Smith et al. | 15/256.51 |
| 3,748,686 | * | 7/1973 | Winterburn et al. | 15/256.51 |
| 3,778,861 | | 12/1973 | Goodnow | 15/256.51 |
| 3,803,665 | | 4/1974 | Winterburn et al. | 15/256.51 |
| 3,854,162 | * | 12/1974 | Russell | 15/256.51 |
| 3,866,266 | | 2/1975 | Dunlap | 15/256.51 |
| 4,367,120 | | 1/1983 | Hendrikz | 162/281 |
| 4,665,859 | | 5/1987 | Dunlap et al. | 118/126 |
| 4,906,335 | | 3/1990 | Goodnow et al. | 162/281 |
| 5,230,775 | * | 7/1993 | Goodnow et al. | 162/281 |
| 5,279,710 | | 1/1994 | Aikawa | 162/281 |
| 5,284,516 | | 2/1994 | Sieberth | 118/123 |
| 5,408,720 | | 4/1995 | Miles | 15/256.51 |

* cited by examiner

*Primary Examiner*—Peter Chin
*Assistant Examiner*—Eric Hug
(74) *Attorney, Agent, or Firm*—Samuels, Gauthier & Stevens

(57) ABSTRACT

A doctor apparatus comprises a base adapted to be fixed to a doctor back and having a shelf projecting forwardly therefrom. A compliant top plate overlies the forwardly projecting shelf. The top plate has a rear portion fixed with respect to the base, and a front portion projecting forwardly beyond the shelf. Mutually spaced blade support members are secured to the underside of the front portion of the top plate. The blade support members have front portions underlying and cooperating in spaced relationship with the underside of the front portion of the top plate to define mutually aligned receiving slots, and have rear portions underlying and cooperating in spaced relationship with the shelf to define mutually aligned recesses. A doctor blade has a rear portion removably retained in the receiving slots, and a front portion projecting forwardly beyond the top plate. A resilient element is confined in the recesses between the shelf and the rear portions of the blade support members.

16 Claims, 7 Drawing Sheets

COMPLIANT TOP PLATE DOCTORING APPARATUS

PRIORITY INFORMATION

This application claims priority from provisional application Ser. No. 60/117,951, filed Jan. 29, 1999.

BACKGROUND OF THE INVENTION

1. Field of the Invention

This invention relates generally to web processing machines, e.g., paper machines, coaters and the like, and is concerned in particular with an improved apparatus for doctoring the rolls of such machines.

2. Description of the Prior Art

The three main components of a doctor system include a rigid doctor structure or beam, a doctor blade holder, and a doctor blade. The doctor system is adapted to be mounted in a paper machine, coater or other like web processing machine and is used to scrape the rotating rolls for cleaning or dewatering purposes. At some critical roll positions in the paper machine, the doctor system is also used during the threading process to remove or "shed" either a full width sheet of paper or a portion of the sheet.

In conventional doctoring, the working edge of a doctor blade is applied to the rotating roll surface from which the material, water or other solutions are to be removed. The critical factors contributing to an effective doctoring operation include a uniform load between the working edge of the blade and the rotating roll surface for the full length of the blade, and maintenance of an optimum blade angle with respect to the roll surface.

FIGS. 1–3 illustrate examples of prior art doctoring systems. In FIGS. 1 and 2, a doctor system includes a doctor back 10 mounted in bearings 12 for rotation about an axis $A_1$. An actuator 14 operates to rotate the doctor back about axis $A_1$ in order to load the working edge of a doctor blade 16 against the surface 18 of a rotating roll 20. A blade holder 22 is mounted to the front of the doctor back 10.

In the following description, it is to be understood that the doctor blade and the principal associated components of the doctoring system, e.g., the doctor back and blade holder, each extend in the "cross machine direction", i.e., parallel to the rotational axis $A_1$ of roll 20, for at least the full width of the web being processed. Moreover, as herein employed, the term "machine direction" is to be understood as referring to the direction of travel of the web through the machine.

As can best be seen in FIG. 2, the blade holder includes a relatively rigid top plate 24 and an underlying jaw 26. The doctor blade 16 is removably received in a slot 28 where it is supported between the top plate 24 and the jaw 26.

The top plate is fastened to the doctor back by threaded screws 30 or the like. Adjustable set screws 32 are provided to adjust the blade holder and doctor blade along the length of the roll 20 in order to accommodate localized roll surface variations. Even though the set screws 32 provide some measure of adjustability, achieving a uniform load between the blade working edge and the varying roll surfaces continues to be problematical. The main drawback of this type of apparatus is that because the doctor blade 16 is held between the top plate 24 and the jaw 26, both being relatively rigid members, there is a lack of flexibility needed to satisfactorily accommodate the often encountered roll surface irregularities.

FIG. 3 illustrates a more advanced prior art doctoring system. Here, a blade holder 34 is again mounted to the doctor back 10. A top plate 36 is pivotally mounted for rotation about an axis $A_2$ defined by a pivot pin 38 extending for the full length of the holder. The pivot pin is threaded through top brackets 40 depending from the top plate 36, and similar base brackets 42 extending upwardly from a channel-shaped base 43. A jaw 44 is mounted to the underside of the top plate 36 in a forward position. The jaw 44 together with the top plate 36 defines a slot 46 in which the doctor blade 16 is removably received for application to the surface 18 of roll 20.

An air or liquid filled load tube 48 extends for the full length of the holder and lies parallel to the pivot pin 38 in a position furthest from the doctor blade 16. The load tube 48 is either inflated to generate a doctor blade loading force, or it provides a reactionary force with the top plate 36 when the doctor back 10 is rotated towards the roll surface 18.

An additional air filled tube 50 is located parallel to the pivot pin 18 in a forward position. When it is necessary to unload the doctor blade 16, either the air filled tube 50 is inflated while the load tube 48 is deflated, or the doctor back 10 is rotated away from the roll surface 18. The air filled tube 50 also creates a seal to prevent debris from entering the holder cavities.

The main disadvantage of this type of doctoring system is that friction between the pivot pin 38 and the top plate brackets 40 along with a relatively low mechanical advantage provided by the load tube 48 combines to make the contact load between the doctor blade and the roll surface somewhat variable and unpredictable. An additional disadvantage is that the necessary clearances present between the pivot pin 38 and the associated brackets 40, 42 makes the doctoring apparatus susceptible to vibration and chatter problems.

Examples of other prior art doctoring arrangements are provided by U.S. Pat. Nos. 4,789,432; 4,367,120; and 3,748,686.

SUMMARY OF THE INVENTION

The objective of the present invention is to provide a uniquely configured and improved doctoring apparatus which avoids or at least significantly minimizes the problems and drawbacks associated with the above described prior art systems, and is thus well suited for a wide range of applications on high speed paper machines or other like web processing equipment.

A more specific objective of the present invention is the provision of a doctoring apparatus which is capable of providing a substantially uniform loading between the doctor blade and the rotating roll surface while accommodating surface irregularities in the roll surface. This uniform loading characteristic is due largely to the flexural characteristics of the components and their unique geometry. Uniform loading between the doctor blade and the rotating roll surface is critical to achieving a more effective cleaning of the roll surface and/or more reliable sheet shedding, while also minimizing roll surface wear and minimizing and promoting even wear of the doctor blade.

The present invention achieves these objectives by relying primarily on the flexural properties of the top plate in combination with a strategically placed resilient member. In contrast to prior art holders utilizing a pivoted top plate assembly, the invention has minimum clearance or play between holder components. This in turn reduces any tendency of the blade holder components to vibrate or chatter. Additionally, the geometry of the present invention is such that doctor blade wear has a minimum effect on the operating doctor blade load or application angle.

These and other objectives, advantages and features of the present invention will now be described in greater detail with reference to the accompanying drawings wherein:

DETAILED DESCRIPTION OF PREFERRED EMBODIMENTS

Figure 1:
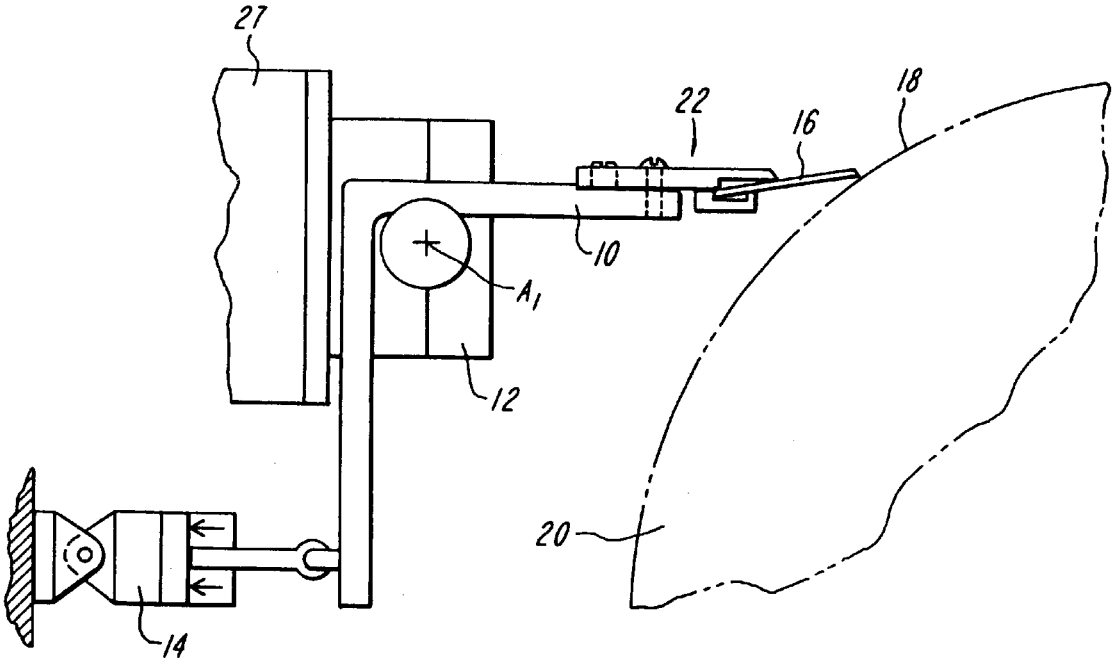
FIG. 1 (PRIOR ART)
FIG. 1 is a schematic illustration of a conventional doctoring apparatus.
Figure 2:
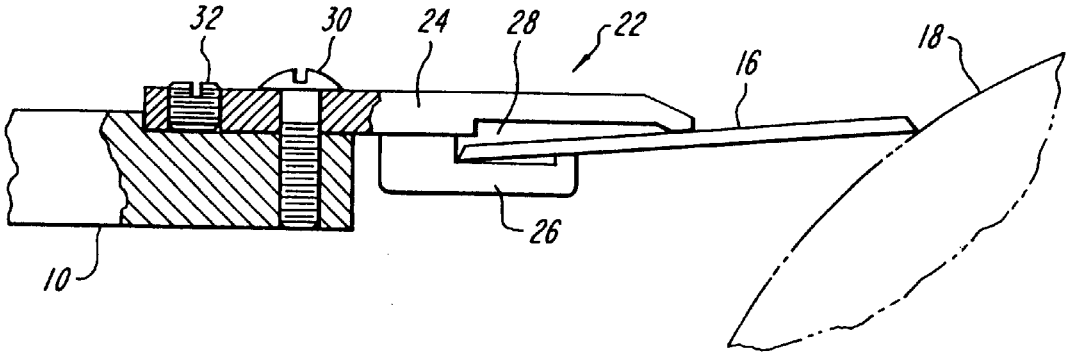
FIG. 2 (PRIOR ART)
FIG. 2 is an enlarged view of the blade holder shown in FIG. 1.
Figure 3:
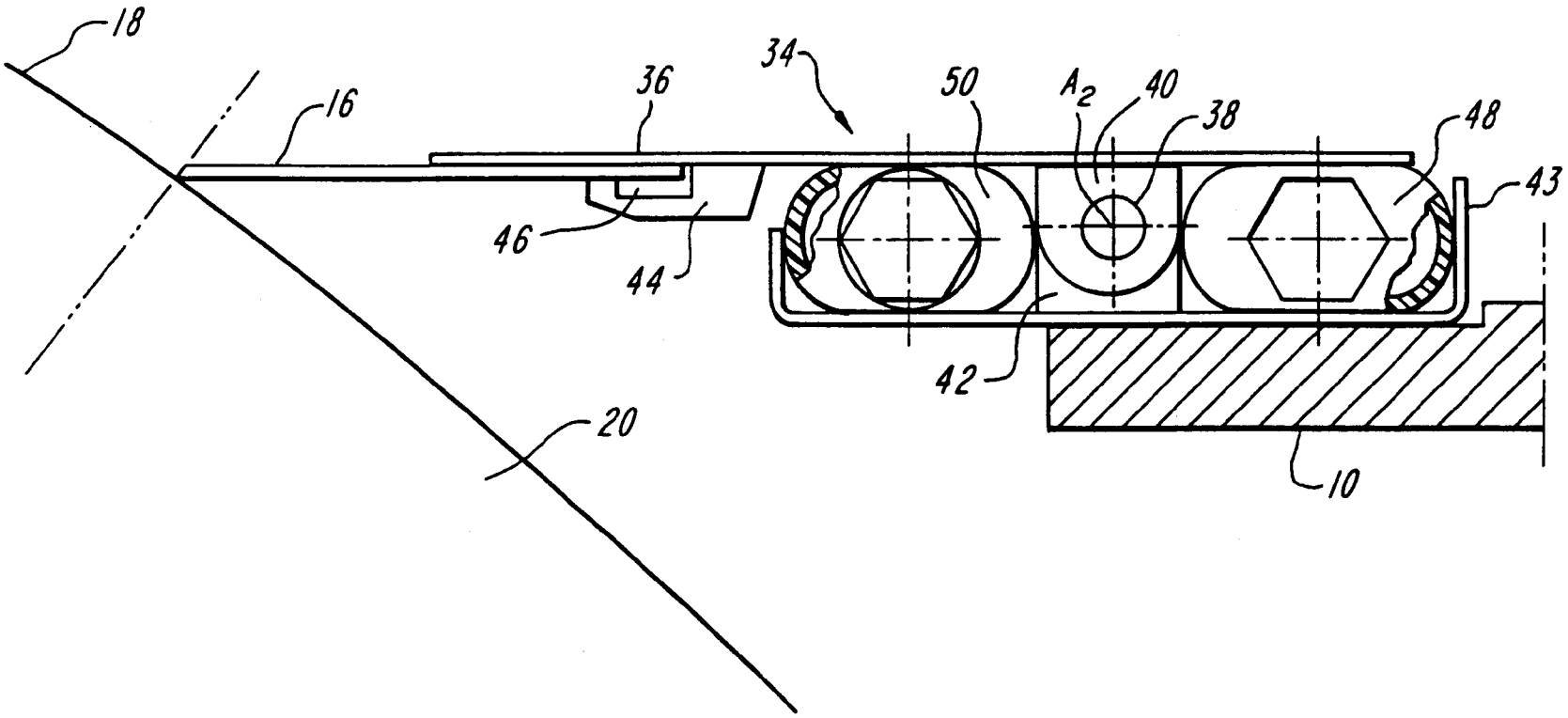
FIG. 3 (PRIOR ART)
FIG. 3 is a view similar to FIG. 2 showing another prior art blade holder construction.
Figure 4:
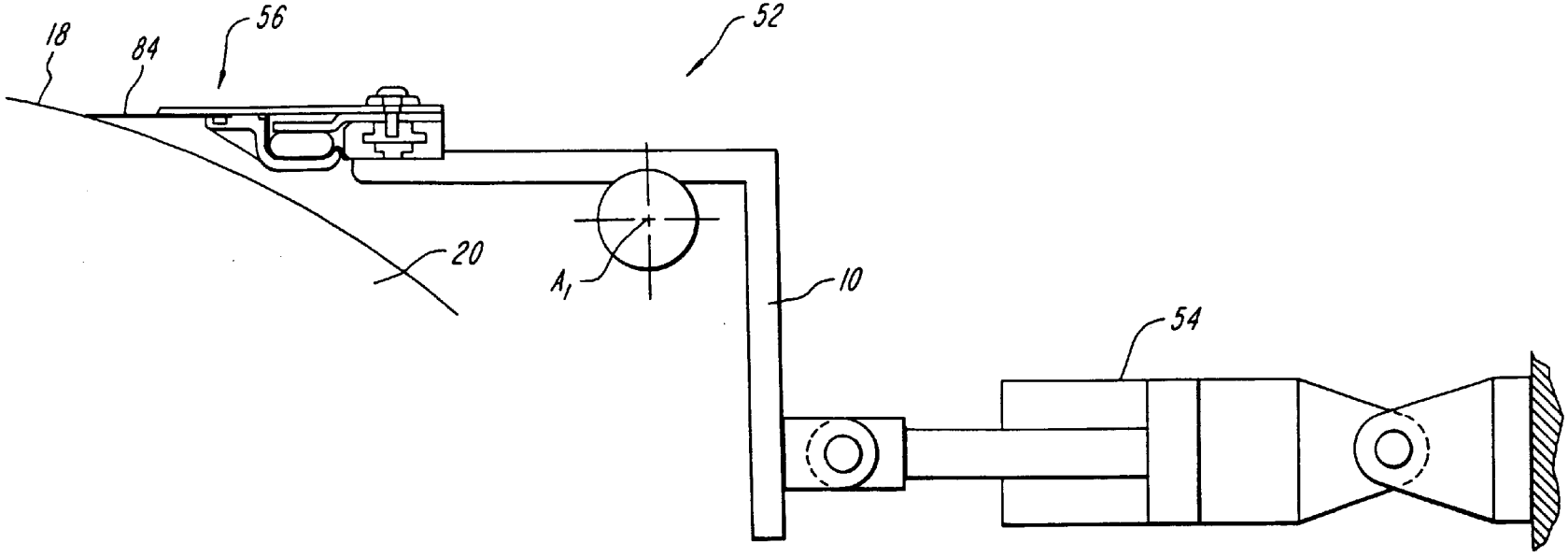
FIG. 4 is a schematic illustration of a doctoring apparatus in accordance with the present invention.

With reference initially to FIG. 4, a doctoring apparatus in accordance with the present invention is shown at 52 adjacent to the rotating surface 18 of a cylindrical roll 20. As with the prior art arrangements previously discussed, the doctoring apparatus includes a doctor back 10 rotatable about an axis $A_1$ by means of an actuator 54. A blade holder in accordance with the present invention and generally indicated at 56 is mounted on the forward end of the doctor back.

Figure 5:
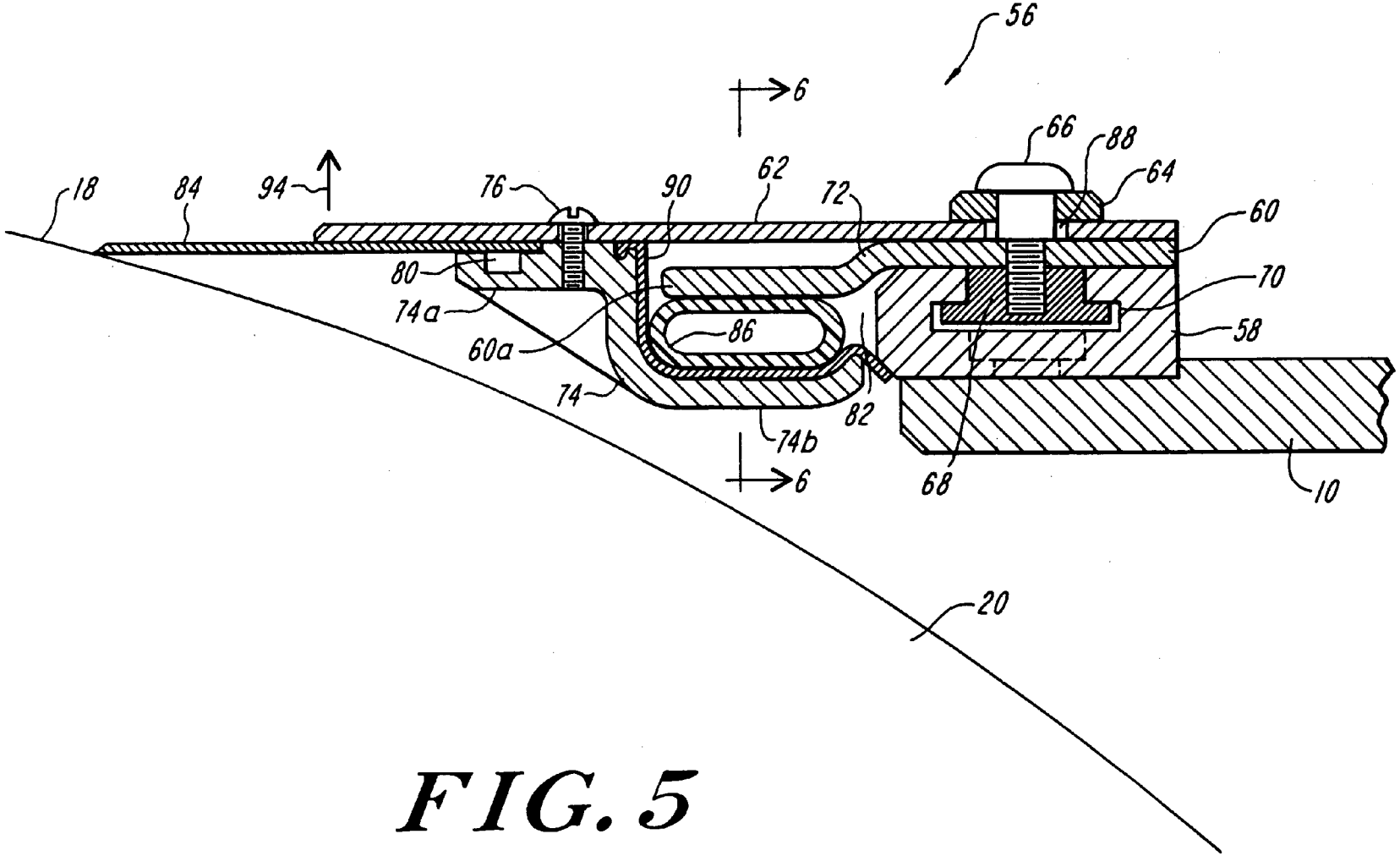
FIG. 5 is an enlarged view of the blade holder shown in FIG. 4.
Figure 6:
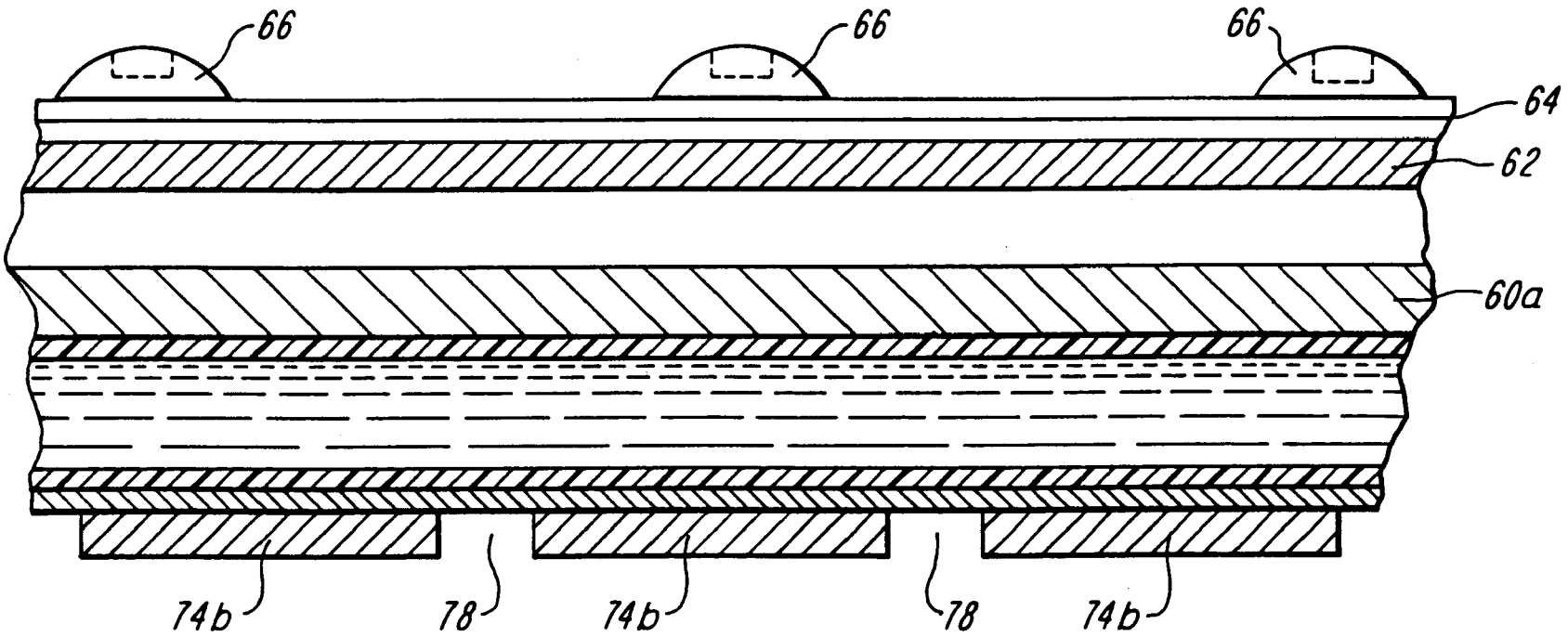
FIG. 6 is a sectional view of an enlarged scale taken along line 6—6 of FIG. 5.
Figure 7:
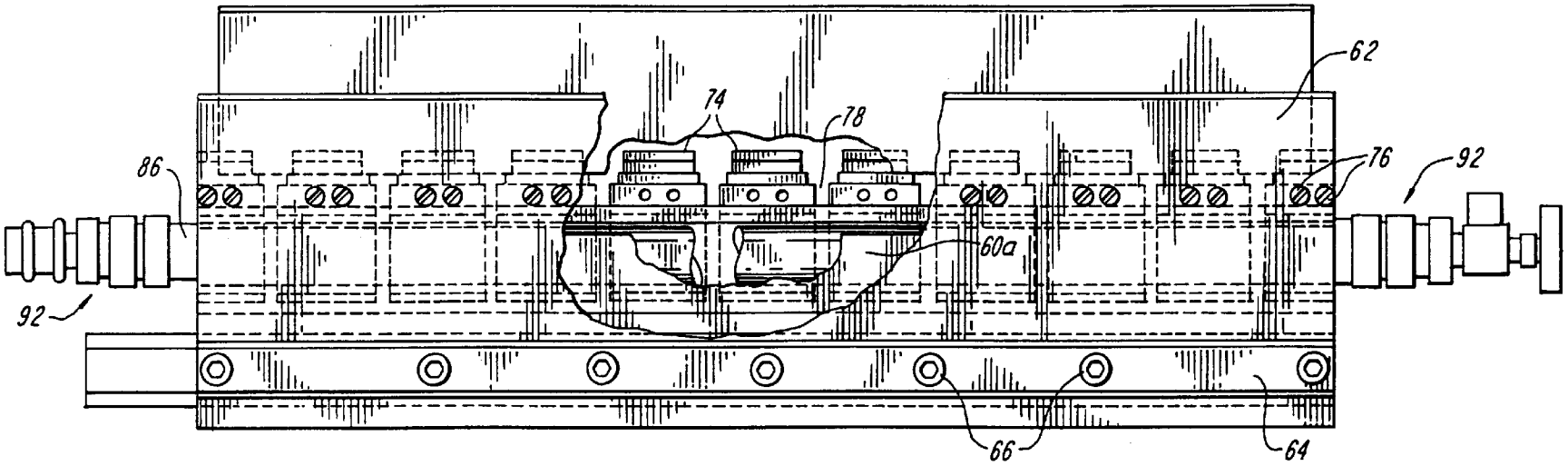
FIG. 7 is a plan view with portions broken away of the blade holder as seen in FIG. 4.

With reference additionally to FIGS. 5–7, it will be seen that the blade holder 56 includes a base 58 adapted to be fixed to the doctor back by any convenient means (not shown). A shelf 60 projects forwardly from the base 58. A compliant top plate 62 overlies the shelf 60 and is fixed in place relative to the base 58 by means of a retaining bar 64 and shoulder screws 66 threaded into a T-bar 68 slidably received in a coactively configured slot 70 extending through the base 58. The shelf 60 is downwardly offset as at 72 to provide a forwardly extending cantilevered segment 60*a* spaced beneath the underside of the top plate 62.

A plurality of blade support members indicated typically by reference numerals 74 are secured to the underside of a front portion of the top plate 62 by means of screws 76 or the like. As can best be seen in FIG. 7, the support members are spaced one from the other as at 78. The support members have front portions 74*a* underlying and cooperating in spaced relationship with the underside of top plate 62 to define mutually aligned receiving slots 80, and rear portions 74*b* underlying and cooperating in spaced relationship with the shelf segment 60*a* to define mutually aligned recesses 82. As herein employed, the term "mutually aligned" is intended to describe an alignment in the cross machine direction.

A doctor blade 84 has its rear edge slidably received and retained in the mutually aligned slots 80 between the forward portions 74*a* of the blade support members 74 and the underside of the top plate 62. The forward edge of the blade 84 is applied to the roll surface 18.

A resilient member 86 is confined in the recesses 82 between the cantilevered segment 60*a* of the shelf and the rear portions 74*b* of the blade support members.

The top plate 62 extends for the full length of the holder and is designed to have optimal machine direction and cross machine direction rigidity for reliable and efficient doctoring. A variety of materials are suitable for the top plate, depending on the intended application. The preferred material is a composite utilizing carbon and/or glass reinforcing fibers within an epoxy resin system. Stainless steel is a less preferred but usable material.

The top plate thickness will also vary with the intended application, and will normally range from between about 0.050 to 0.1875 inch.

To allow for a difference in thermal expansion of the top plate 62 with respect to the retainer bar 64 and the underlying rear segment of the shelf 60, the top plate is slotted in the machine direction as at 88. The axial dimension of the enlarged diameter shoulders on the screws 66 is selected to provide an optimal clamping force for the top plate material being utilized. This clamping force will cause the top plate to lay flat against the underlying support surface of the shelf 60 while allowing for thermal expansion and contraction of the top plate. This accommodation of thermal expansion is important when the top plate material is different from that of the other adjacent components of the blade holder.

When included as a separate component, the shelf 60 is sandwiched tightly between the top surface of the base 58 and the underlying surface of the top plate 62. Alternatively, the forwardly projecting shelf segment 60*a* could be machined as an integral part of the base 58.

By simply loosening the shoulder screws 66, a unitary assembly comprising elements 60, 62, 64, 66, 68, 74, 86 together with the doctor blade 84 can be slidably removed from the base 58 as a single unit, thereby facilitating cleaning and maintenance of the blade holder assembly.

Although the element 68 has been illustrated with a T-shaped cross section, it will be understood that other mechanically interengageable configurations may be employed to accomplish the same task, which is to provide a means of removably securing and slidably extracting and replacing the above described unitary assembly.

The blade support members 74 are evenly spaced across the full length of the holder. Typically, the blade support members will have a width of approximately 1.75 inches with a 0.25 inch gap therebetween. This gap between blade support members will allow the top plate 62 to deflect as needed in the cross machine direction to accommodate variations in the rotating roll surface.

An optional seal 90 lines the interior of the recesses 82 and extends the full length of the holder to thereby span the gap between the blade support members 74. The seal prevents debris from entering the recesses 82.

The resilient member 86 can comprise a flexible walled tube, as shown, partially filled with a fluid, with its ends sealed as at 92. Alternatively, an elastomer or other resilient material in a solid bar shape could be substituted for the tube 86.

In light of the foregoing, it will be understood that as the actuator 54 rotates the doctor back 10 in a counterclockwise direction as viewed in FIG. 4, the doctor blade 84 will be loaded against the rotating surface 18 of the roll 20. After initial contact, and as blade loading is increased, the leading edge of the top plate 62 will deflect upwardly relative to its trailing or secured edge, as indicated by arrow 94 in FIG. 5. As the top plate deflects upwardly, the resilient member 86 becomes compressed, causing a reactionary force against both the rear portions 74*b* of the blade support members and the cantilevered segment 60*a* of the shelf 60. The reaction force between the resilient member and the blade support members 74 controls top plate deflection and greatly contributes to a uniform contact load between the doctor blade and the rotating surface 18 of the roll, even when roll surface variations are encountered. The resilient member 86, in effect, forces a good fit between the doctor blade and the rotating roll surface. The resilient member 86 is positioned such that is has a high degree of mechanical advantage in its influence over the top plate and doctor blade.

The preferred top plate material is an engineered composite that has reinforcement fibers biased in the machine direction, resulting in increased machine direction rigidity and decreased cross machine rigidity. The top plate thickness and flexural properties are designed such that the deflection occurring at the leading edge of the top plate can be varied slightly along its length to accommodate the expected variations in the roll surface.

In addition to its importance in controlling top plate deflection, the resilient member 86 is capable of dissipating energy and will therefore act as a vibration damper. Vibration damping characteristics continue to gain importance as paper machine speeds and widths increase.

Figure 8:
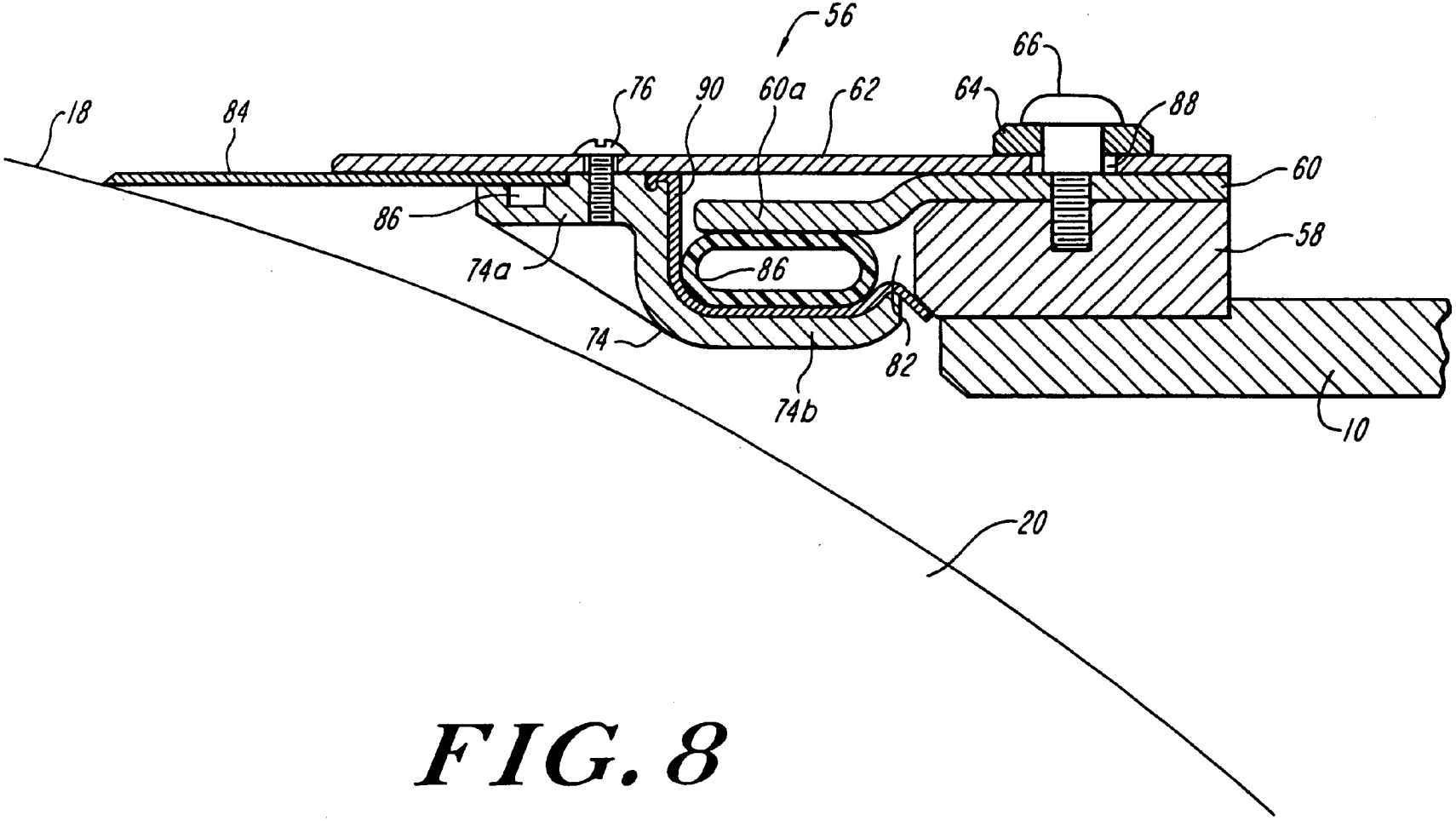
FIG. 8 is a view similar to FIG. 5 showing an alternative embodiment of the invention.

In FIG. 8, an alternative embodiment of the invention is illustrated wherein the shoulder screws 66 are threaded directly into the base 58. In all other respects, the FIG. 8 arrangement is identical to that previously described with reference to FIGS. 4–7.

As a further alternative to the above described embodiments, the blade holder assembly 56 could be placed on a doctor back or support that is essentially fixed rigidly in space adjacent to the cylindrical rotating surface 18 of a roll 20. In this case, means would be provided for expanding and contracting the resilient member 86, typically by varying the amount of fluid contained therein. An increase in the volume of fluid would cause increased flexural bending of the top plate assembly and a resulting increase in the contact load between the doctor blade and rotating roll surface. By contrast, a decrease in the volume of fluid would cause a decrease in flexural bending of the top plate and a resulting decrease in the contact load. The volume of fluid in the resilient member 86 could be further decreased to the point where flexural bending of the top plate is either reduced to an absolute minimum or completely relieved in order to accommodate removal of the doctor blade from the blade holder assembly.

In light of the foregoing, it will now be appreciated by those skilled in the art that the present invention represents a significant departure from prior art blade holder assemblies, and as such provides advantages not heretofore available. Of particular importance is the role of the resilient member 86 which coacts with the mutually spaced blade support members 74 and the resilient top plate 62 to resiliently accommodate roll surface variations. This is achieved without introducing rotatable elements and their associated working clearances into the blade holder assembly, thereby significantly reducing and in most cases largely eliminating vibration and chattering problems.

While the foregoing description has centered on the doctoring of rotating roll surfaces, it will be understood that the present invention is also applicable to the doctoring of other moving support surfaces that are non rotatable, one example being the surface of a belt or the like on which a web is carried in the machine direction.

We claim:

1. A doctor apparatus comprising:

a base adapted to be fixed to a doctor back, said base having a shelf projecting forwardly therefrom;

a compliant top plate overlying said shelf, said top plate having a rear portion fixed with respect to said base, and having a front portion projecting forwardly beyond said shelf;

mutually spaced blade support members secured to the underside of the front portion of said top plate, said blade support members having front portions underlying and cooperating in spaced relationship with the underside of the front portion of said top plate to define mutually aligned receiving slots, and having rear portions underlying and cooperating in spaced relationship with said shelf to define mutually aligned recesses;

a doctor blade having a rear portion removably retained in said receiving slots and having a front portion projecting forwardly beyond said top plate; and a resilient element confined in said recesses between said shelf and the rear portions of said blade support members.

2. In a machine for processing a web traveling in a machine direction and in contact with a moving support surface, a doctoring apparatus extending in the cross machine direction at a location adjacent to said support surface, said doctoring apparatus comprising:

a base, a shelf and a compliant top plate, each of which extends continuously in the cross machine direction, said base being adapted to be fixed to a doctor back with said shelf projecting forwardly therefrom in the machine direction towards said roll, and said top plate overlying said shelf and having a rear portion fixed with respect to said base and a front portion projecting forwardly in the machine direction beyond said shelf;

a plurality of blade support members secured to the underside of the front portion of said top plate, said blade support members being spaced one from the other in the cross machine direction, with front portions cooperating in spaced relationship with the underside of the front portion of said top plate to define mutually aligned receiving slots, and with rear portions underlying and cooperating in spaced relationship with said shelf to define mutually aligned recesses;

a doctor blade having a rear portion removably retained in said receiving slots and having a front portion projecting forwardly beyond said top plate to terminate in a leading edge positioned for application to the surface of said roll; and a resilient element confined in said recess between said shelf and the rear portions of said blade support members.

3. The doctoring apparatus of claims 1 or 2 wherein said shelf is spaced from the underside of said top plate.

4. The doctoring apparatus of claims 1 or 2 wherein said resilient member is a flexible walled tube sealed at its opposite ends and partially filled with a fluid.

5. The doctoring apparatus of claims 1 or 2 wherein said resilient member is a solid resilient element.

6. The doctoring apparatus of claims 1 or 2 wherein said shelf comprises a plate member having a rear portion tightly sandwiched between said base and said top plate, and a front portion downwardly offset with respect to said rear portion and spaced beneath the underside of said top plate.

7. The doctoring apparatus of claims 1 or 2 wherein said resilient member comprises a flexible walled tube sealed at its opposite ends, and means for expanding and contracting said tube to resiliently deflect said top plate with respect to said base.

8. The doctoring apparatus of claims 1 or 2 wherein said shelf, top plate and blade support members comprise an integral assembly which is removable as a unit from said base.

9. The doctoring apparatus of claims 1 or 2 further comprising a seal member lining the interior of said recess and extending across the rear portions of said mutually spaced blade support members.

10. The doctoring apparatus of claim 2 further comprising means for rotatably adjusting said doctor back to forcibly apply the leading edge of said doctor blade to said support surface.

11. The doctoring apparatus of claim 2 wherein said doctor back is fixed, and wherein a means is provided for expanding said resilient element to forcibly apply the leading edge of said doctor blade to said support surface.

12. The doctoring apparatus of claims 2, 10 or 11 wherein said support surface is the surface of a rotating roll.

13. A doctor apparatus comprising:

a base adapted to be fixed to a doctor back, said base having a rigid shelf projecting forwardly therefrom;

a blade holder assembly including a compliant plate having a rear portion fixed with respect to said base, and having a front portion projecting forwardly beyond said shelf, said blade holder assembly cooperating in spaced relationship with said shelf to define a recess located between said base and the front portion of said plate;

a doctor blade removably retained on and projecting forwardly from the front portion of said plate; and a resilient element confined in said recess.

14. The doctor apparatus of claim 13 wherein said resilient element comprises a flexible walled tube sealed at its opposite ends, and means for expanding and contracting said tube to resiliently deflect said plate with respect to said base.

15. The doctor apparatus of claim 13 further comprising means for rotatably adjusting said doctor back to forcibly apply a leading edge of said doctor blade to a surface to be doctored.

16. The doctor apparatus of claim 13 wherein said doctor back is fixed, and wherein a means is provided for expanding said resilient element to forcibly apply a leading edge of said doctor blade to a surface to be doctored.

* * * * *